US008771150B2

(12) United States Patent
Warren

(10) Patent No.: US 8,771,150 B2
(45) Date of Patent: Jul. 8, 2014

(54) EXERCISE DEVICE

(76) Inventor: William J. Warren, Addison, TX (US)

( * ) Notice: Subject to any disclaimer, the term of this patent is extended or adjusted under 35 U.S.C. 154(b) by 104 days.

(21) Appl. No.: 13/477,086

(22) Filed: May 22, 2012

(65) Prior Publication Data

US 2013/0316883 A1 Nov. 28, 2013

(51) Int. Cl.
*A63B 21/00* (2006.01)

(52) U.S. Cl.
CPC ..... *A63B 21/00* (2013.01)
USPC ..... 482/49; 482/141

(58) Field of Classification Search
USPC ..... 482/55, 49, 141, 111; 441/59, 11, 58
See application file for complete search history.

(56) References Cited

U.S. PATENT DOCUMENTS

| | | | | |
|---|---|---|---|---|
| 3,786,526 | A * | 1/1974 | Ausseil | 441/59 |
| 3,913,907 | A * | 10/1975 | Baker | 482/111 |
| 5,011,137 | A * | 4/1991 | Murphy | 482/55 |
| 5,102,120 | A * | 4/1992 | Lindblad | 482/111 |
| 6,540,647 | B2 * | 4/2003 | Spooner et al. | 482/55 |
| 6,899,581 | B1 * | 5/2005 | Nokes | 441/58 |

* cited by examiner

*Primary Examiner* — Jerome W Donnelly
(74) *Attorney, Agent, or Firm* — Wilson Daniel Swayze, Jr.

(57) ABSTRACT

An exercise device to provide exercise for a user may include a base panel to provide resistance in a fluid, a finger handle to connect to the base panel and to provide support for the hand of the user and a wrist restraint device to connect to the base panel and to restrain the wrist of the user. The finger handle may be substantially an inverted U-shaped.

8 Claims, 18 Drawing Sheets

EXERCISE DEVICE

FIELD OF THE INVENTION

The present invention relates to an exercise device and more particularly to a handheld exercise device with a wrist stabilizer or restrainer.

BACKGROUND

Despite the negative connotation, may people exercise on a regular basis in order to maintain weight or to enjoy a healthy lifestyle. These exercises usually include some type of equipment in order to provide a muscular tension or resistance in the hands, arms, feet and legs. It is desirable for an exercise device to obtain resistance from air, and it is equally desirable to obtain this resistance from water which may enhance the experience of the user. Furthermore, the exercise device may be needed in order to steer and propel a watercraft or other device.

SUMMARY

An exercise device to provide exercise for a user may include a base panel to provide resistance in a fluid, a finger handle to connect to the base panel and to provide support for the hand of the user and a wrist restraint device to connect to the base panel and to restrain the wrist of the user.

The finger handle may be substantially an inverted U-shaped.

The wrist restraint device may include a base arm.

The wrist restraint device may include an upward extending arm connected to the base arm.

The wrist restraint device may include a wrist restraining arm connected to the upward extending arm.

The wrist restraint device may include a enclosing arm to connect to the wrist restraining arm and to enclose the wrist restraint device around the wrist of the user.

The base panel may include a front portion which curves upwards with respect to a back portion of the base panel.

The base panel may include a front surface being planar.

The base panel may include a front surface being curved.

The front surface may be convexly curved.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
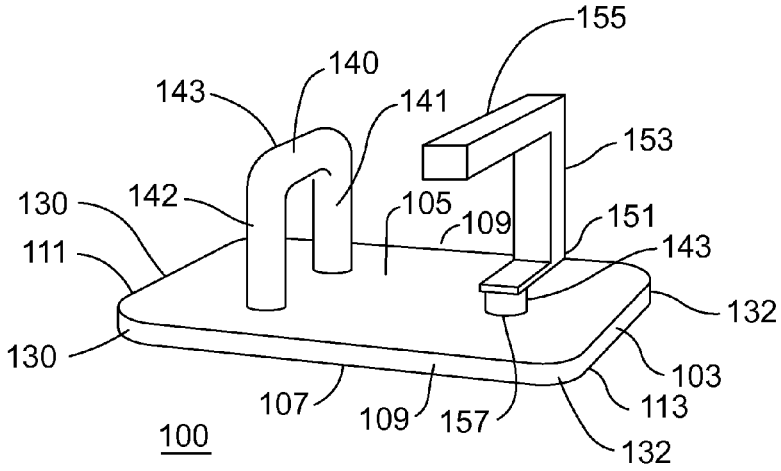
FIG. 1 illustrates a side perspective view of the exercise device of the present invention.

FIG. 1 illustrates a side perspective view of the exercise device 100 of the present invention which may include a base panel 103 which may be substantially rigid and may be formed from plastic, Plexiglas, metal, wood or other appropriate material. The base panel 103 may include a front surface 111 which may be opposed to a back surface 113 and may be connected to a pair of opposing side surfaces 109 by a pair of front curved surfaces 130, a top surface 105 and a bottom surface 107, the top surface 105 may be connected to the pair of opposing side surfaces 109, the front surface 111, and the back surface 113, the bottom surface 107 may be connected to the pair of opposing side surfaces 109, the front surface 111 and the back surface 113, the back surface 113 may be connected to the top surface 105, the bottom surface 107 by a pair of back curved surfaces 132, and the side surface 109, and the pair of side surfaces 109 may be connected to the top surface 105, the bottom surface 107, front surface 111 and the back surface 103. The base panel 103 may have a cross-section of a square, rectangle, oval circle, paddle shaped or other appropriate shape.

FIG. 1 additionally illustrates a finger handle 140 which may be flexible or rigid and may be formed from Velcro (hooks and loops) or a flexible cord and may be substantially an inverted U-shaped device which may include a pair of downward extending arms 141 which may extend into apertures 143 which may extend through the base panel 103. The pair of extending arms 141 may be connected to a base arm 145. The finger handle 140 may extend in a traverse direction to the base panel 103. The finger handle 140 may be grasped by the hand of the user.

FIG. 1 additionally illustrates a wrist restraint device 150 which may be positioned behind the finger handle 140 and which may include base arm 151 which may be connected to a upward extending arm 153 and which may extend traverse to the base panel 103. The upward extending arm 153 may be substantially perpendicular to the base arm 151 and may be connected to a wrist restraint device arm 155 which may be substantially parallel to the base arm 151 and may be substantially horizontal. The wrist restraining arm 155 may be traverse to the base panel 103. The base arm 151 may be connected to a cylinder 157 which may extend through the aperture 143.

In operation, the user may grasp the finger handle 140 with the fingers of the user and the wrist or forearm may slide under the wrist restraint device 150, more particularly the wrist restraining arm 155, in order to stabilize the exercise device 100 while the user is swinging the exercise device 100.

Figure 2:
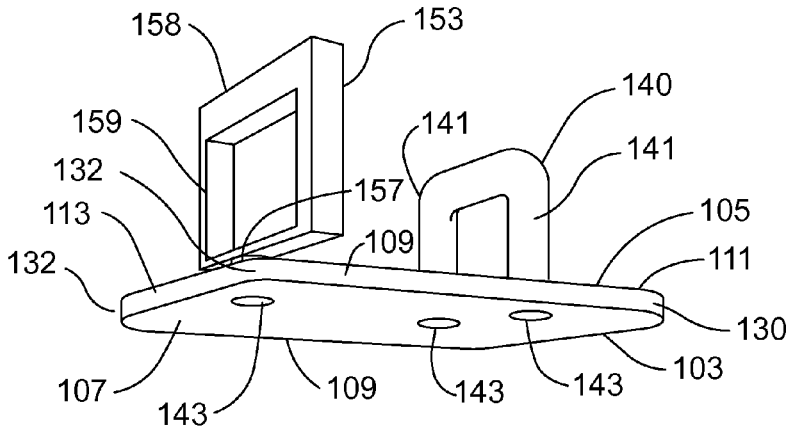
FIG. 2 illustrates a bottom perspective view of the exercise device of the present invention.

FIG. 2 illustrates a bottom perspective view of the exercise device 100 of the present invention which may include a base panel 103 which may be substantially rigid and may be formed from plastic, Plexiglas, metal, wood or other appropriate material. The base panel 103 may include a front surface 111 which may be opposed to a back surface 113 and may be connected to a pair of opposing side surfaces 109 by a pair of front curved surfaces 130, a top surface 105 and a bottom surface 107, the top surface 105 may be connected to the pair of opposing side surfaces 109, the front surface 111, and the back surface 113, the bottom surface 107 may be connected to the pair of opposing side surfaces 109, the front surface 111 and the back surface 113, the back surface 113 may be connected to the top surface 105, the bottom surface 107 by a pair of back curved surfaces 132, and the side surface 109, and the pair of side surfaces 109 may be connected to the top surface 105, the bottom surface 107, front surface 111 and the back surface 103. The base panel 103 may have a cross-section of a square, rectangle, oval circle, paddle shaped or other appropriate shape.

FIG. 2 additionally illustrates a finger handle 140 which may be flexible or rigid and may be formed from Velcro (hooks and loops) or a flexible cord and may be substantially an inverted U-shaped device which may include a pair of downward extending arms 141 which may extend into apertures 143 which may extend through the base panel 103. The pair of extending arms 141 may be connected to a base arm 145. The finger handle 140 may extend in a traverse direction to the base panel 103. The finger handle 140 may be grasped by the hand of the user.

FIG. 2 additionally illustrates a wrist restraint device 150 which may be positioned behind the finger handle 140 and which may include base arm 151 which may be connected to a upward extending arm 153 and which may extend traverse to the base panel 103. The upward extending arm 153 may be substantially perpendicular to the base arm 151 and may be connected to a wrist restraint device arm 155 which may be substantially parallel to the base arm 151 and may be substantially horizontal. The wrist restraining arm 155 may be traverse to the base panel 103. The base arm 151 may be connected to a cylinder 157 which may extend through the aperture 143.

FIG. 2 additionally illustrates an enclosing arm 157 which may connect the base arm 151 with the wrist restraining arm 155 and which may be substantially vertical and parallel to the upward extending arm 153.

Figure 3:
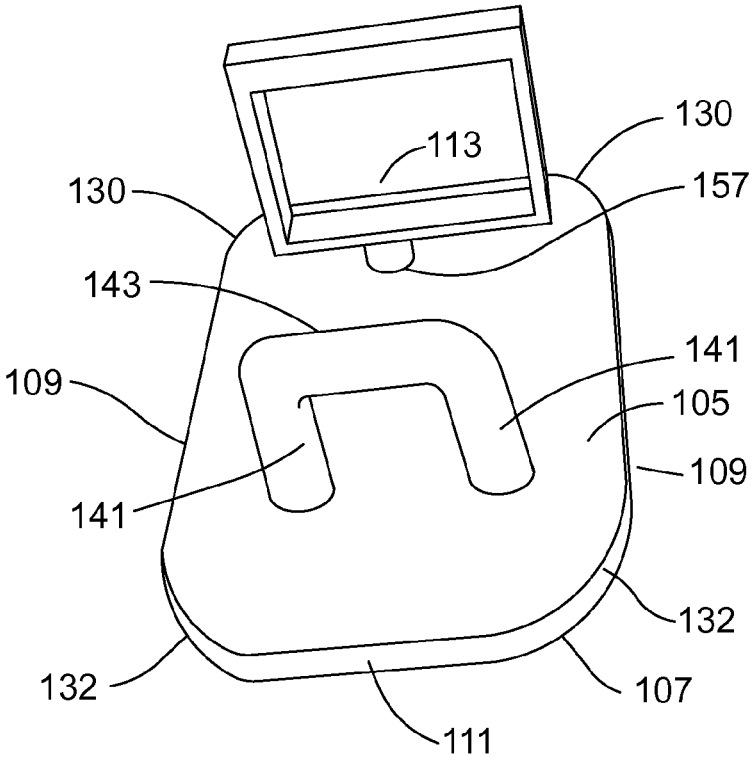
FIG. 3 illustrates a top perspective view of the exercise device of the present invention.

FIG. 3 illustrates a front perspective view of the exercise device 100 of the present invention which may include a base panel 103. The base panel 103 may include a front surface 111 which may be opposed to a back surface 113 and may be connected to a pair of opposing side surfaces 109 by a pair of front curved surfaces 130, a top surface 105 and a bottom surface 107, the top surface 105 may be connected to the pair of opposing side surfaces 109, the front surface 111, and the back surface 113, the bottom surface 107 may be connected to the pair of opposing side surfaces 109, the front surface 111 and the back surface 113, the back surface 113 may be connected to the top surface 105, the bottom surface 107 by a pair of back curved surfaces 132, and the side surface 109, and the pair of side surfaces 109 may be connected to the top surface 105, the bottom surface 107, front surface 111 and the back surface 103. The base panel 103 may have a cross-section of a square, rectangle, oval circle, paddle shaped or other appropriate shape.

FIG. 3 additionally illustrates a finger handle 140 which may be flexible or rigid and may be formed from Velcro (hooks and loops) or a flexible cord and may be substantially an inverted U-shaped device which may include a pair of downward extending arms 141 which may extend into apertures 143 which may extend through the base panel 103. The pair of extending arms 141 may be connected to a base arm 145. The finger handle 140 may extend in a traverse direction to the base panel 103. The finger handle 140 may be grasped by the hand of the user.

FIG. 3 additionally illustrates a wrist restraint device 150 which may be positioned behind the finger handle 140 and which may include base arm 151 which may be connected to a upward extending arm 153 and which may extend traverse to the base panel 103. The upward extending arm 153 may be substantially perpendicular to the base arm 151 and may be connected to a wrist restraint device arm 155 which may be substantially parallel to the base arm 151 and may be substantially horizontal. The wrist restraining arm 155 may be traverse to the base panel 103. The base arm 151 may be connected to a cylinder 157 which may extend through the aperture 143.

Figure 4:
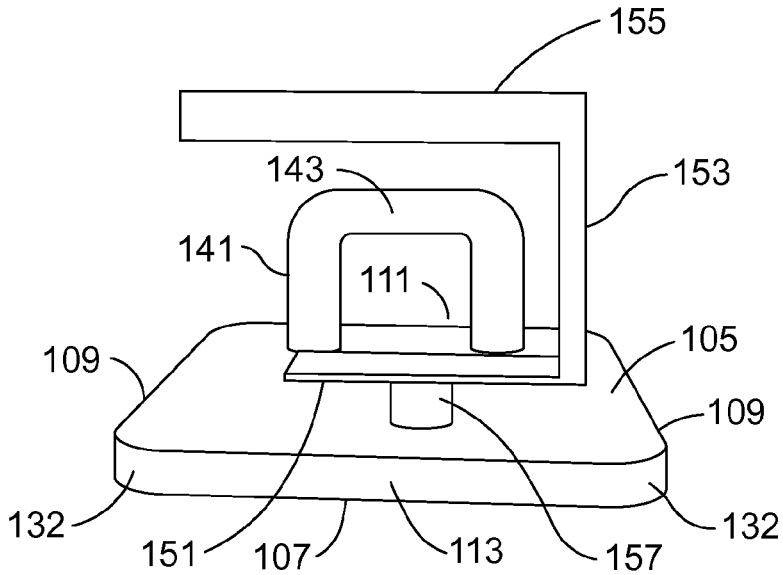
FIG. 4 illustrates a back perspective view of the exercise device of the present invention.

FIG. 4 illustrates a back perspective view of the exercise device 100 of the present invention which may include a base panel 103 which may be substantially rigid and may be formed from plastic, Plexiglas, metal, wood or other appropriate material. The base panel 103 may include a front surface 111 which may be opposed to a back surface 113 and may be connected to a pair of opposing side surfaces 109 by a pair of front curved surfaces 130, a top surface 105 and a bottom surface 107, the top surface 105 may be connected to the pair of opposing side surfaces 109, the front surface 111, and the back surface 113, the bottom surface 107 may be connected to the pair of opposing side surfaces 109, the front surface 111 and the back surface 113, the back surface 113 may be connected to the top surface 105, the bottom surface 107 by a pair of back curved surfaces 132, and the side surface 109, and the pair of side surfaces 109 may be connected to the top surface 105, the bottom surface 107, front surface 111 and the back surface 103. The base panel 103 may have a cross-section of a square, rectangle, oval circle, paddle shaped or other appropriate shape.

FIG. 4 additionally illustrates a finger handle 140 which may be flexible or rigid and may be formed from Velcro (hooks and loops), a flexible cord and may be substantially an inverted U-shaped device which may include a pair of downward extending arms 141 which may extend into apertures 143 which may extend through the base panel 103. The pair of extending arms 141 may be connected to a base arm 145. The finger handle 140 may extend in a traverse direction to the base panel 103. The finger handle 140 may be grasped by the hand of the user.

FIG. 4 additionally illustrates a wrist restraint device 150 which may be positioned behind the finger handle 140 and which may include base arm 151 which may be connected to a upward extending arm 153 and which may extend traverse to the base panel 103. The upward extending arm 153 may be substantially perpendicular to the base arm 151 and may be connected to a wrist restraint device arm 155 which may be substantially parallel to the base arm 151 and may be substantially horizontal. The wrist restraining arm 155 may be traverse to the base panel 103. The base arm 151 may be connected to a cylinder 157 which may extend through the aperture 143.

Figure 5:
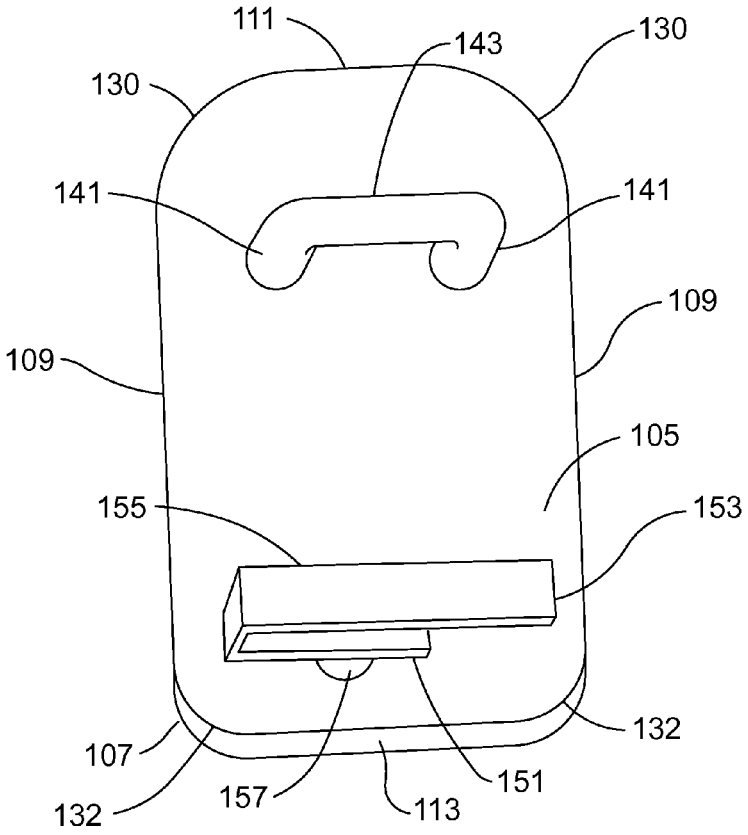
FIG. 5 illustrates a top perspective view of the exercise device of the present invention.

FIG. 5 illustrates a bottom perspective view of the exercise device 100 of the present invention which may include a base panel 103 which may be substantially rigid and may be formed from plastic, Plexiglas, metal, wood or other appropriate material. The base panel 103 may include a front surface 111 which may be opposed to a back surface 113 and may be connected to a pair of opposing side surfaces 109 by a pair of front curved surfaces 130, a top surface 105 and a bottom surface 107, the top surface 105 may be connected to the pair of opposing side surfaces 109, the front surface 111, and the back surface 113, the bottom surface 107 may be connected to the pair of opposing side surfaces 109, the front surface 111 and the back surface 113, the back surface 113 may be connected to the top surface 105, the bottom surface 107 by a pair of back curved surfaces 132, and the side surface 109, and the pair of side surfaces 109 may be connected to the top surface 105, the bottom surface 107, front surface 111 and the back surface 103. The base panel 103 may have a cross-section of a square, rectangle, oval circle, paddle shaped or other appropriate shape.

FIG. 5 additionally illustrates a finger handle 140 which may be flexible or rigid and may be formed from Velcro (hooks and loops) or a flexible cord and may be substantially an inverted U-shaped device which may include a pair of downward extending arms 141 which may extend into apertures 143 which may extend through the base panel 103. The pair of extending arms 141 may be connected to a base arm 145. The finger handle 140 may extend in a traverse direction to the base panel 103. The finger handle 140 may be grasped by the hand of the user.

FIG. 5 additionally illustrates a wrist restraint device 150 which may be positioned behind the finger handle 140 and which may include base arm 151 which may be connected to a upward extending arm 153 and which may extend traverse to the base panel 103. The upward extending arm 153 may be substantially perpendicular to the base arm 151 and may be connected to a wrist restraint device arm 155 which may be substantially parallel to the base arm 151 and may be substantially horizontal. The wrist restraining arm 155 may be traverse to the base panel 103. The base arm 151 may be connected to a cylinder 157 which may extend through the aperture 143.

Figure 6:
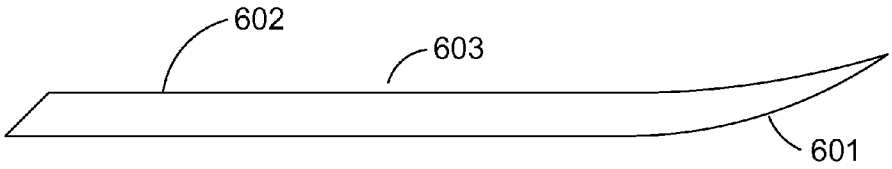
FIG. 6 illustrates the base panel of the exercise device of the present invention.

FIG. 6 illustrates a side view of a base panel 603 which may include a front portion 601 which may be upwardly curved with respect to the back portion 602.

Figure 7:
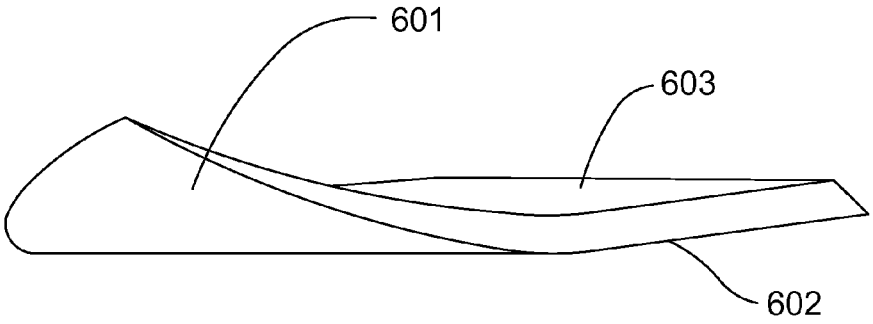
FIG. 7 illustrates a perspective view of the base panel of the present invention.

FIG. 7 illustrates a front view of a base panel 603 which may include a front portion 601 which may be upwardly curved with respect to the back portion 602.

Figure 8:
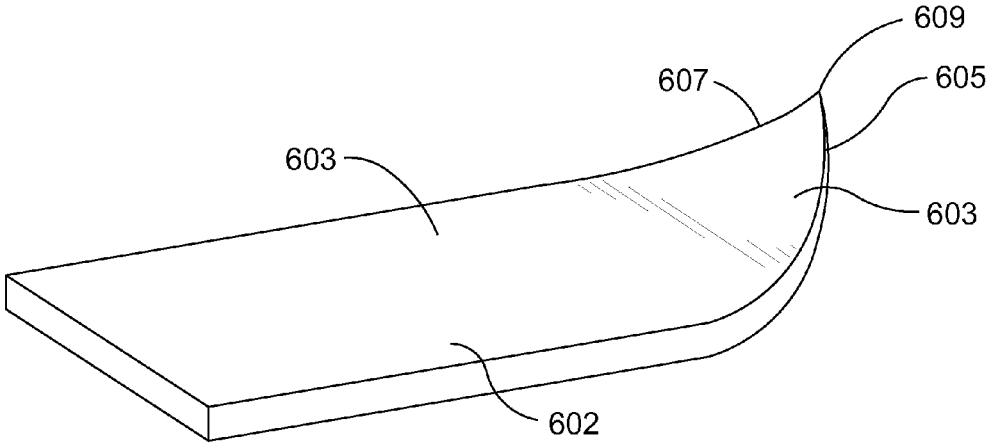
FIG. 8 illustrates a perspective view of the base panel of the present invention.

FIG. 8 illustrates a perspective view of a base panel 603 which may include a front portion 601 which may be upwardly curved with respect to the back portion 602. The base panel 603 may include a first curved front surface 605 which may form a front edge 609 with a second curved front surface 607.

Figure 9:
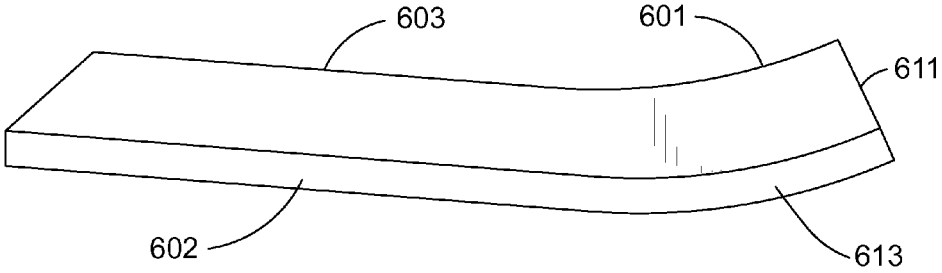
FIG. 9 illustrates a perspective view of the base panel of the present invention.

FIG. 9 illustrates a perspective view of a base panel 603 which may include a front portion 601 which may be upwardly curved with respect to the back portion 602. The front surface 611 may be substantially planar and perpendicular to the side surface 613.

Figure 10:
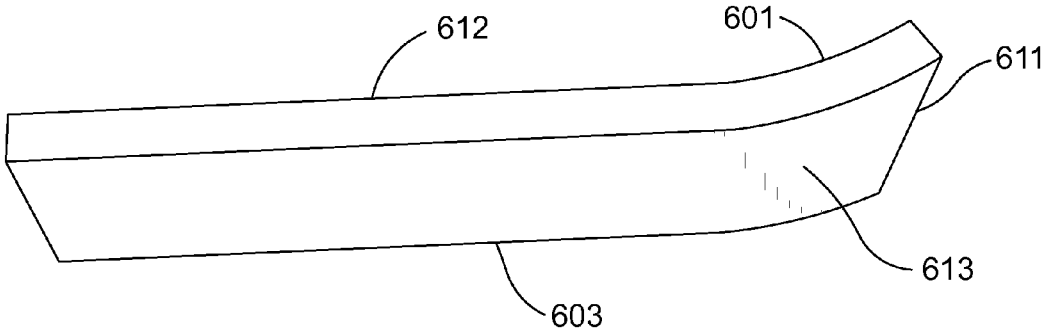
FIG. 10 illustrates a perspective view of the base panel of the present invention.

FIG. 10 illustrates a bottom perspective view of a base panel 603 which may include a front portion 601 which may be upwardly curved with respect to the back portion 602. The front surface 611 may be substantially planar and perpendicular to the side surface 613.

Figure 11:
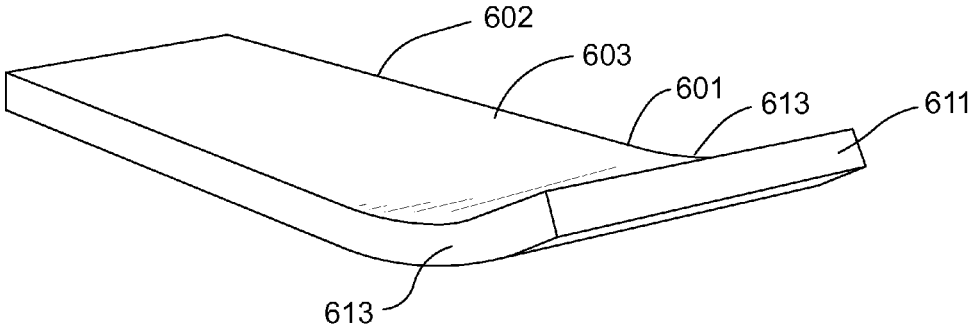
FIG. 11 illustrates a perspective view of the base panel of the present invention.

FIG. 11 illustrates a front perspective view of a base panel 603 which may include a front portion 601 which may be upwardly curved with respect to the back portion 602. The front surface 611 may be substantially planar and perpendicular to the side surface 613.

Figure 12:
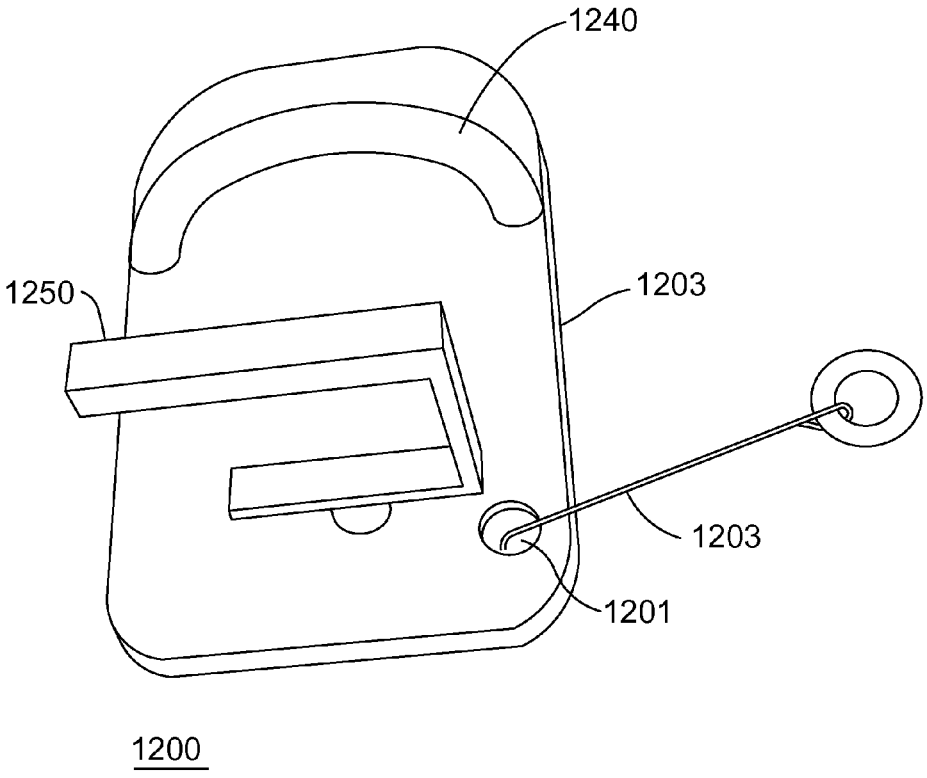
FIG. 12 illustrates a perspective view of the exercise device of the present invention.

FIG. 12 illustrates a back perspective view of the exercise device 1200 which may include a wrist restraint device 1250 which may be rigid and which may extend from side to side of the base panel 1203 and may include a finger handle 1240 which may be flexible. The base panel 1203 may include a aperture 1201 which may be connected to a cord 1203 which may serve as a leash to restrain the movement of the exercise device 1200.

Figure 13:
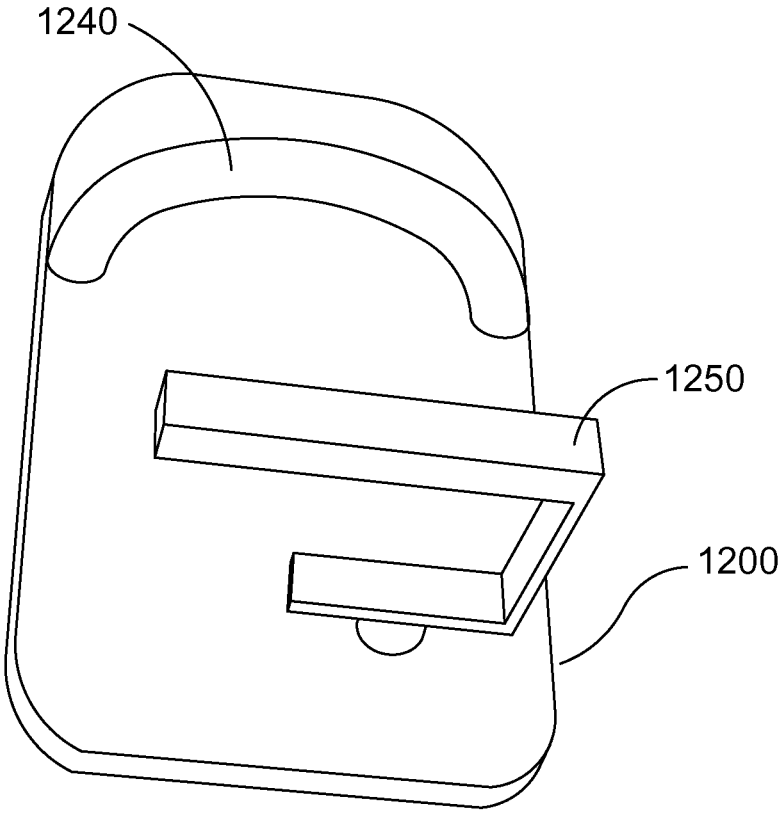
FIG. 13 illustrates a perspective view of the exercise device of the present invention.

FIG. 13 illustrates a back perspective view of the exercise device 1200 which may include a wrist restraint device 1250 which may be rigid and may include a finger handle 1240 which may be flexible and which may extend from side to side of the base panel 1203.

Figure 14:
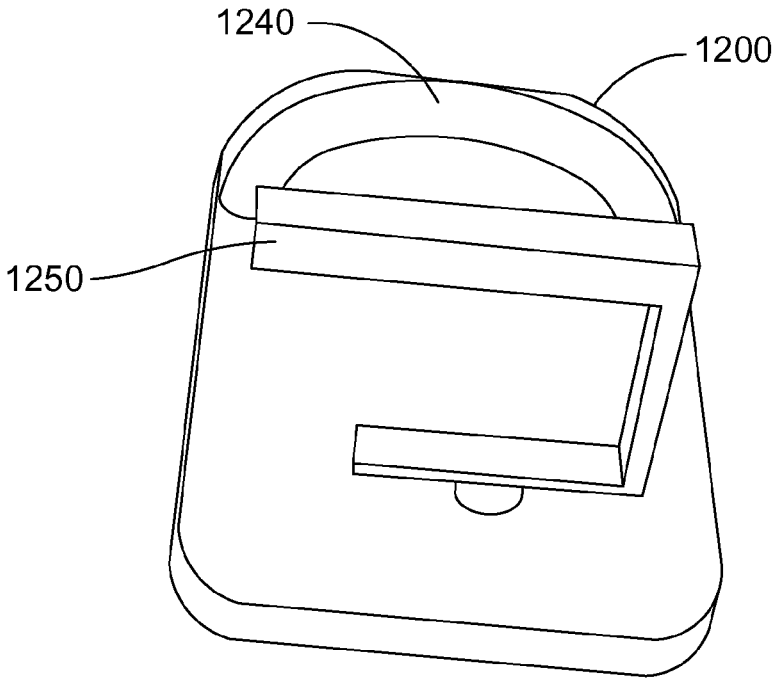
FIG. 14 illustrates a perspective view of the exercise device of the present invention.

FIG. 14 illustrates a back perspective view of the exercise device 1200 which may include a wrist restraint device 1250 which may be rigid and may include a finger handle 1240 which may be flexible and which may extend from side to side of the base panel 1203.

Figure 15:
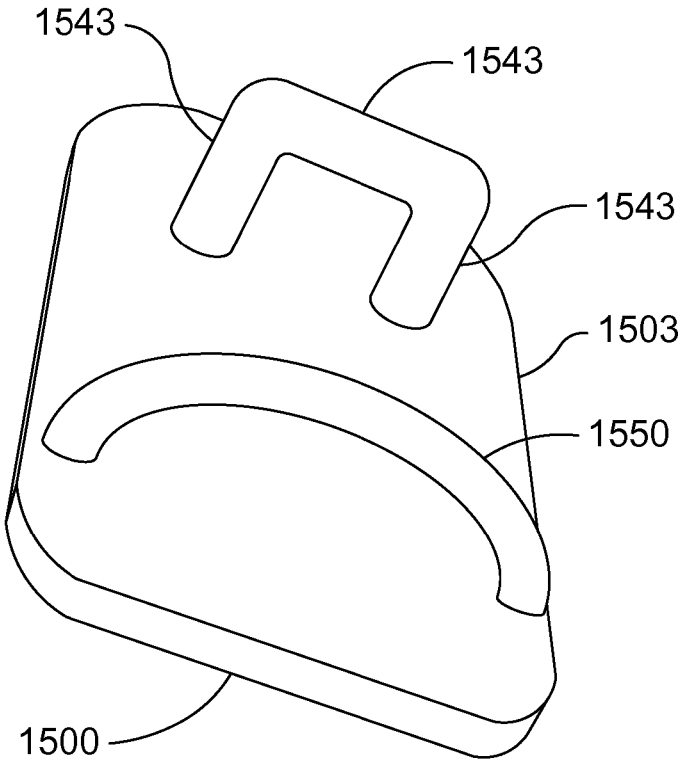
FIG. 15 illustrates a perspective view of the exercise device of the present invention.

FIG. 15 illustrates a back perspective view of the exercise device 1500 which may include a wrist restraint device 1550 which may be flexible and which may extend from side to side of the base panel 1503 and may include a finger handle 1540 which may be rigid and which may be U-shaped and may include a pair of opposed downward extending arms 1541 and a base arm 1543 to connect to the downward extending arms 1541.

Figure 16:
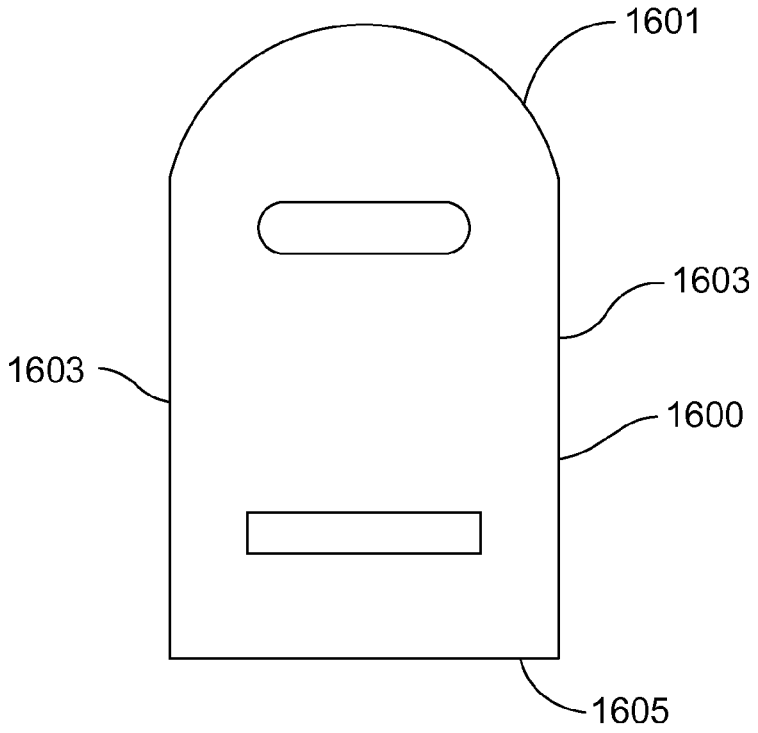
FIG. 16 illustrates a top view of the exercise device of the present invention.

FIG. 16 illustrates an exercise device 1600 which may include a convex curved front surface 1601 and substantially planar side surface 1603 and substantially planar back surface 1605

Figure 17:
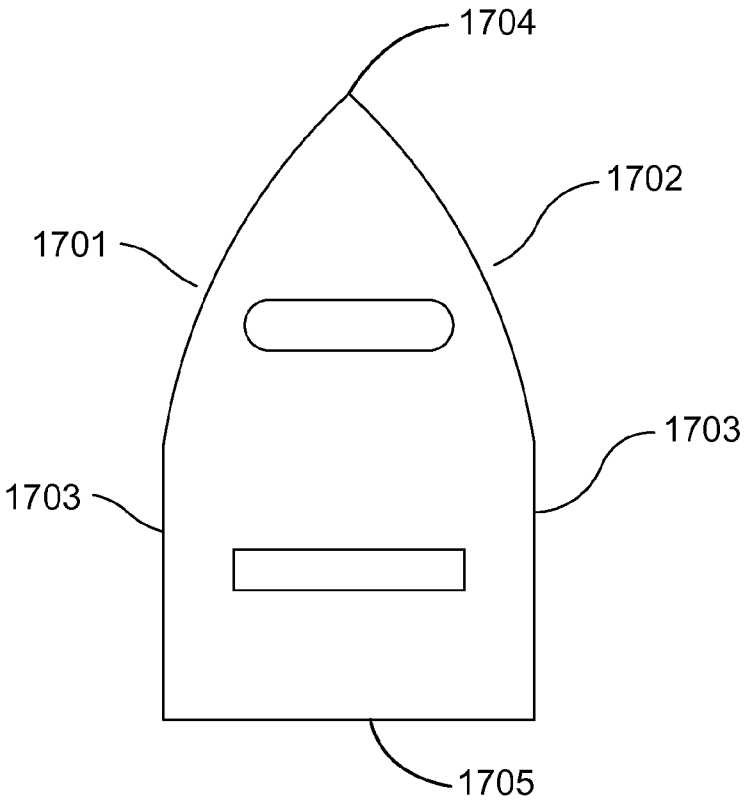
FIG. 17 illustrates a top view of the exercise device of the present invention.

FIG. 17 illustrates an exercise device 1700 which may include a first curved front surface 1701 and a second curved front surface 1702 which connects to the first curved front surface 1701 at an edge 1704 and substantially planar side surface 1703 and substantially planar back surface 1705.

Figure 18:
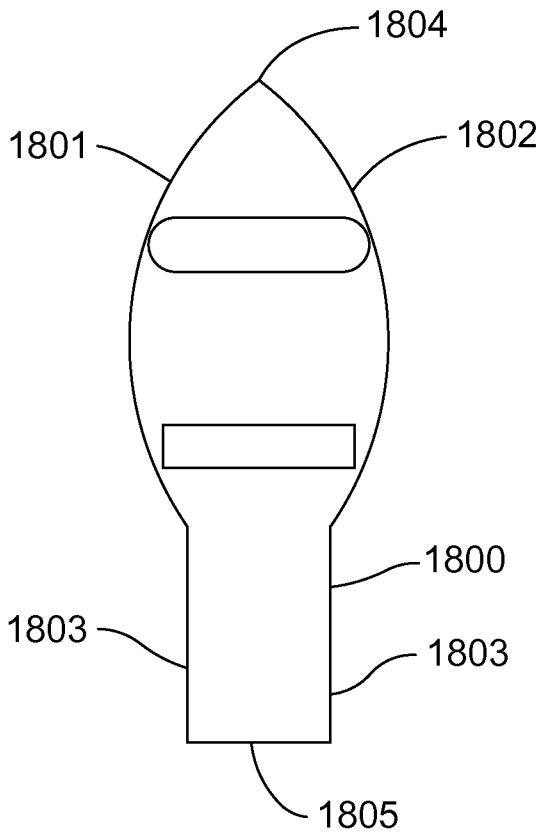
FIG. 18 illustrates a top view of the exercise device of the present invention.

FIG. 18 illustrates an exercise device 1800 which may include a first convex front surface 1801 and a second convex front surface 1802 which connects to the first curved front surface 1801 at an edge 1804 and substantially planar side surface 1803 and substantially planar back surface 1805.

Figure 19:
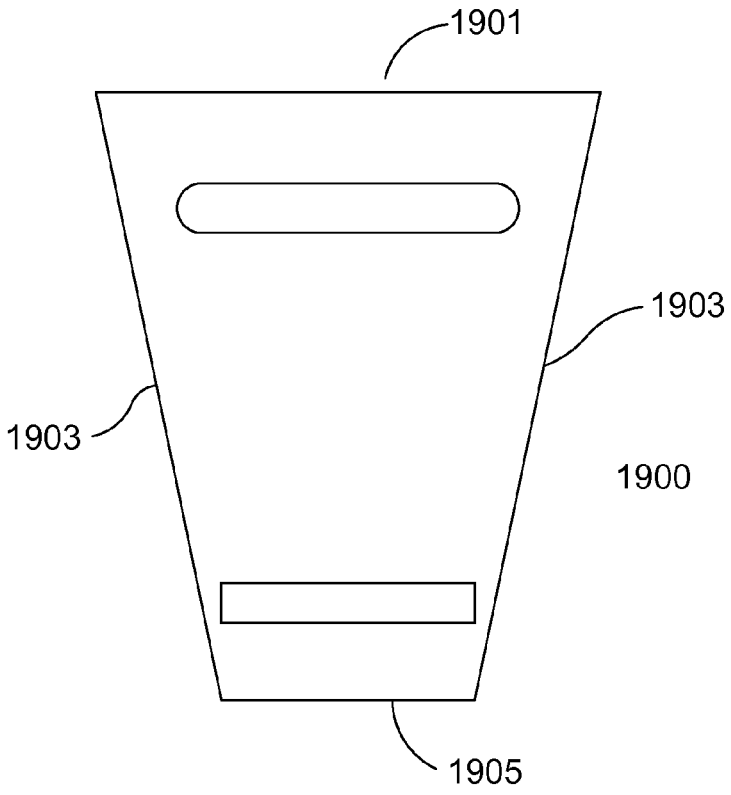
FIG. 19 illustrates a top view of the exercise device of the present invention.

FIG. 19 illustrates an exercise device 1900 which may be a truncated triangular shape and which may include a substantially planar front surface 1901, a substantially inclined side surface 1903 and substantially planar back surface 1905.

Figure 20:
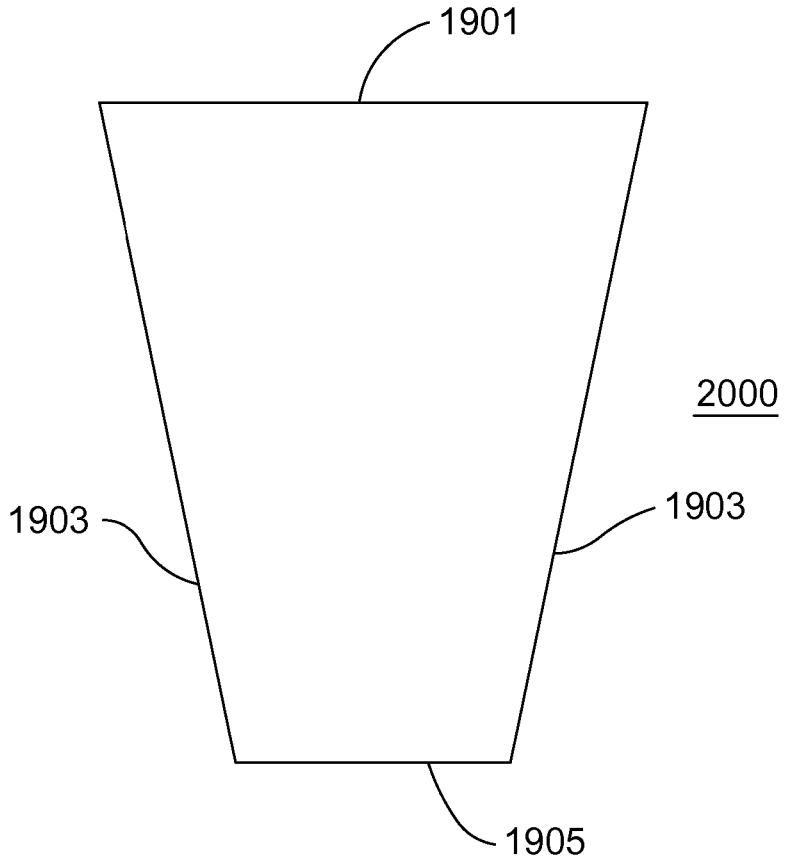
FIG. 20 illustrates a top view of the exercise device of the present invention.

FIG. 20 illustrates an exercise device 2000 which may be a truncated triangular shape and which may include a substantially planar front surface 1901, a substantially inclined side surface 1903 and substantially planar back surface 1905.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An exercise device to provide exercise for a user comprising:

a base panel to provide resistance in a fluid;

a finger handle to connect to the base panel and to provide support for the hand of the user;

a wrist restraint device to connect to the base panel and to restrain the wrist of the user; wherein the wrist restraint device includes a base arm; and wherein the wrist restraint device includes an upward extending arm connected to the base arm.

2. An exercise device to provide exercise for a user as in claim 1, wherein the finger handle is substantially an inverted U-shaped.

3. An exercise device to provide exercise for a user as in claim 1, wherein the wrist restraint device includes a wrist restraining arm connected to the upward extending arm.

4. An exercise device to provide exercise for a user as in claim 3, wherein the wrist restraint device includes a enclosing arm to connect to the wrist restraining arm and to enclose the wrist restraint device around the wrist of the user.

5. An exercise device to provide exercise for a user as in claim 1, wherein the base panel includes a front portion which curves upwards with respect to a back portion of the base panel.

6. An exercise device to provide exercise for a user as in claim 1, wherein the base panel includes a front surface being planar.

7. An exercise device to provide exercise for a user as in claim 1, wherein the base panel includes a front surface being curved.

8. An exercise device to provide exercise for a user as in claim 7, wherein the front surface is convexly curved.

* * * * *